US005453030A

United States Patent [19]

Broussard

[11] Patent Number: 5,453,030

[45] Date of Patent: Sep. 26, 1995

[54] TROLLING MOTOR AUXILIARY HANDLE APPARATUS

[76] Inventor: Kendal G. Broussard, 20540 Hwy. 182 W., Jenerette, La. 70544

[21] Appl. No.: 278,228

[22] Filed: Jul. 21, 1994

[51] Int. Cl.[6] ..... B63H 5/125

[52] U.S. Cl. ..... 440/6; 440/53; 440/87; 114/144 R

[58] Field of Search ..... 114/144 R, 144 A; 440/6, 84, 87, 53

[56] References Cited

U.S. PATENT DOCUMENTS

| | | | |
|---|---|---|---|
| 2,615,418 | 10/1952 | Aspenleiter | 440/87 |
| 3,955,438 | 5/1976 | Zakrzewski | 114/144 R |
| 4,681,056 | 7/1987 | Friedle et al. | 114/144 R |
| 4,698,032 | 10/1987 | Hill | 440/6 |
| 4,841,203 | 6/1989 | Gilbert . | |
| 5,030,145 | 7/1991 | Chase . | |
| 5,129,845 | 7/1992 | Henderson . | |
| 5,145,427 | 9/1992 | Kawai et al. . | |

*Primary Examiner*—Jesús D. Sotelo
*Attorney, Agent, or Firm*—Robert Montgomery

[57] ABSTRACT

The present invention is an auxiliary steering handle apparatus adaptable to most boat mounted trolling motors. The apparatus is comprised of two main components, the pivotal telescopic handle or lever and a split gear housing or case. The pivotal handle or lever is both rotatable and telescopically extendable. Bevel and pinion gears are provided, with the bevel gear split into two halves for clamp mounting to the rotatable steering column of an existing electric trolling motor. Manual rotation of the handle facilitates rotation of the pinion gear and bevel gear, thus axial rotation of the motor is achieved in a full 360 continuous or by-directional rotation. Electrical commutation located within the case and lever, provides sliding electrical contact between a battery and the electric trolling motor.

10 Claims, 3 Drawing Sheets

TROLLING MOTOR AUXILIARY HANDLE APPARATUS

BACKGROUND OF THE INVENTION

1. Field of the Invention

This invention relates generally to trolling motor control apparatus and more particularly to such control apparatus involving extension handles having rotary gear boxes which are adaptable to existing trolling motors.

2. General Background

Small, battery powered, electric motors referred to as trolling motors are quite frequently mounted on the bow of small water craft to provide quiet propulsion and maneuvering in confined areas. Such motors in some cases have been equipped with remote electric controls so as to provide a means of steering the motor from one of the passenger seats. However, more frequently the motor is steered by rotating a short fixed handle similar to that used on larger outboard motors. This procedure requires someone onboard the craft to sit adjacent the motor and steer the boat into position. In some cases this is achieved by moving the motor handle with the passenger's foot.

As indicated above trolling motors have been equipped with electric servo controls for steering the motor remotely. Such controls are expensive and require additional power to operate. Examples of such controls can be seen in U.S. Pat. Nos. 5,129,845 and 4,841,203. The problem of providing a way to control such motors without the expense associated with servo controls indicates that it must be controlled manually in some manner. As indicated above the manufacturer does provide a short handle for this purpose. However, such handles are awkward to operate on most modern fishing craft. Thus the need exist for a method and apparatus which will allow the motor to be operated manually while the operator is standing and without the need to pivot the handle in a port or starboard manner.

Steering handle extensions have been devised for outboard motors and tillers which allow the operator to raise or lower the handle while operating the throttle of an engine or stand some distance from the engine or tiller. Such steering mechanisms are depicted by U.S. Pat. Nos. 5,145,427, 4,681,056 and 3,955,438. However, these apparatus still fail to provide a method for rotating the motor or tiller without moving the motor handle in a port or starboard manner.

A method for manually driving, steering and tilting a boat propeller with a single handle utilizing a bevel gear arrangement is disclosed by Chase in U.S. Pat. No. 5,030,145. However, this device fails to provide for pivoting and extending the handle in an upwardly direction, nor does it adapt to existing trolling motors.

SUMMARY OF THE PRESENT INVENTION

The present invention addresses the need for an apparatus which can be adapted to existing trolling motors. The present apparatus provides an extended handle for trolling motors which is pivotal in the vertical plane, thus, allowing the operator to stand or sit some distance from the motor. The handle is rotatable, thereby operating a bevel gear train which rotates the drive shaft of the trolling motor. Electric commutation is also provided to allow for on-off control at the handle's hand grip.

Therefore, it is an object of this invention to provide a telescopic extendable pivotal handle for trolling motors which allows the operator to stand or sit some extended distance from the motor.

It is a further object of this invention to provide manual means for steering a trolling motor without moving the handle in a lateral manner and still provide 360 degree axial rotation of the motor.

Another object of the present invention is to provide electrical power and on-off control for electric trolling motors in a single telescopic manually operated rotary steering handle.

Still a further object of the invention is to provide such a handle means which is adaptable to existing trolling motors.

BRIEF DESCRIPTION OF THE DRAWINGS

The present invention will be better understood by reference to the following detailed description of a preferred embodiment of the present invention when read in conjunction with the accompanying drawings in which.

DETAILED DESCRIPTION OF THE PREFERRED EMBODIMENT

Figure 1:
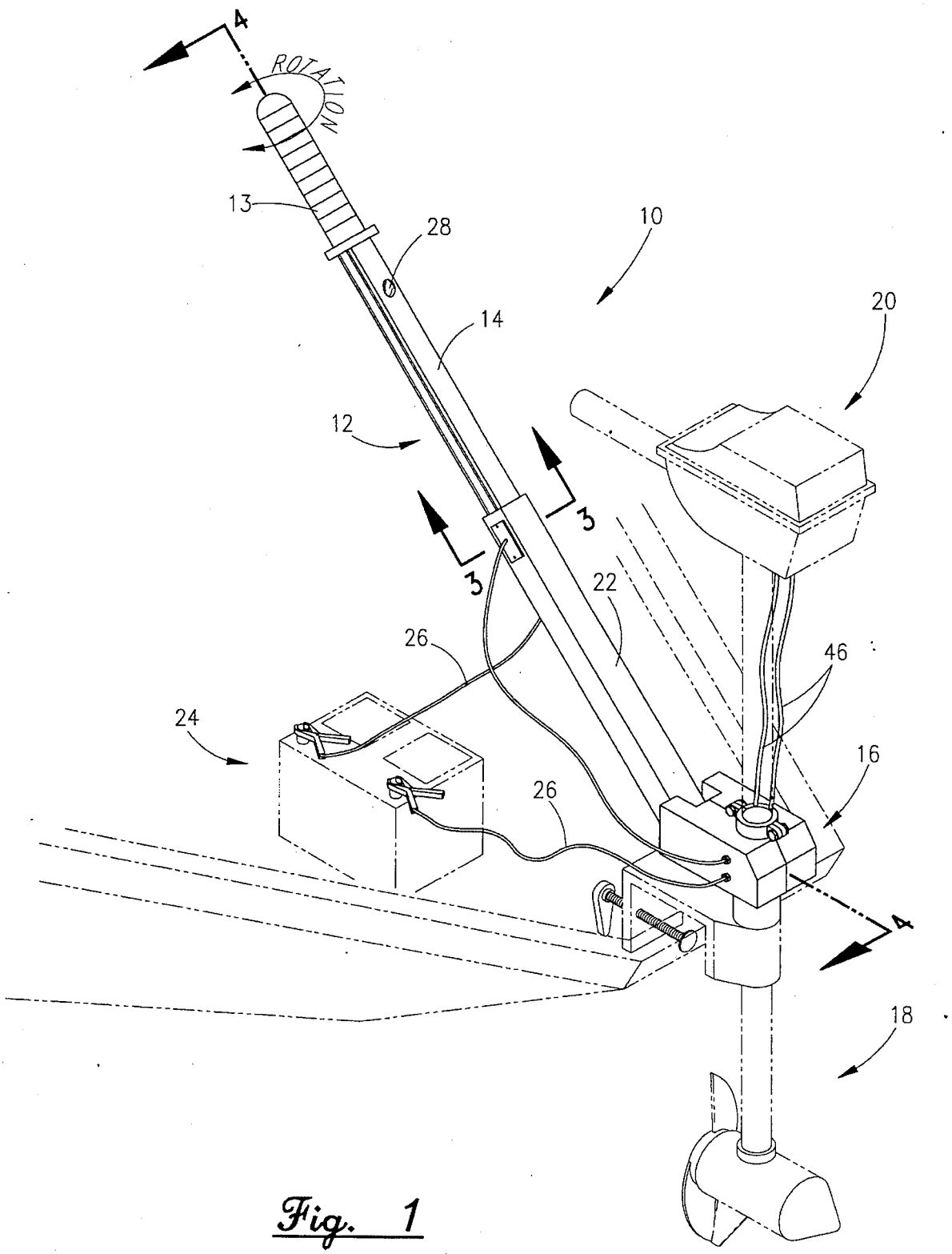
FIG. 1 is an isometric elevation view of the invention as adapted to an existing trolling motor in its normal operating position on a boat.

The present invention as illustrated in FIG. 1 show how the apparatus 10 is adapted to an existing boat mounted trolling motor 20. The trolling motor steering handle apparatus 10 differs from the prior art in that its pivotal lever 12 is both rotatable and telescopic.

The apparatus is comprised of two main components, the pivotal telescopic handle or lever 12 and the split gear housing or case 16. The handle or lever 12 is pivotal in the vertical plane, via holes 52 mounted to the gear housing or case 16. The bevel gear **36*a*, 36*b* has a tubular hub with an axial bore which is split into two essentially equal halves to allow for clamp mounting to the rotatable steering column 18 of an existing electric trolling motor 20**.

The pivotal handle or lever 12 is comprised of a pivotal sleeve 22 which is pivotally captured via trunnions 42 between the two halves **16*a*, 16*b* of the gear housing or case 16, an intermediate slide member 14, and primary and secondary rotary members 15, 30. The intermediate slide member 14 is telescopically extendable from within the pivotal sleeve 22 whereas the primary rotary element 15 and its grip 13 are rotatable within the intermediate slide member 14. Secondary rotary element 30 is telescopically extendable from within the primary rotary element 15 and is rotatable by spline 17. Secondary rotary element 30 is flexibly connected via a spring 32 or a similar member to a beveled pinion gear 34 rotatably located inside the split gear housing or case 16. The pinion gear 34 meshes with a split bevel gear 36*a*, 36*b*, which is bored to fit around an existing troll motor's drive shaft housing 18**.

Figure 4:
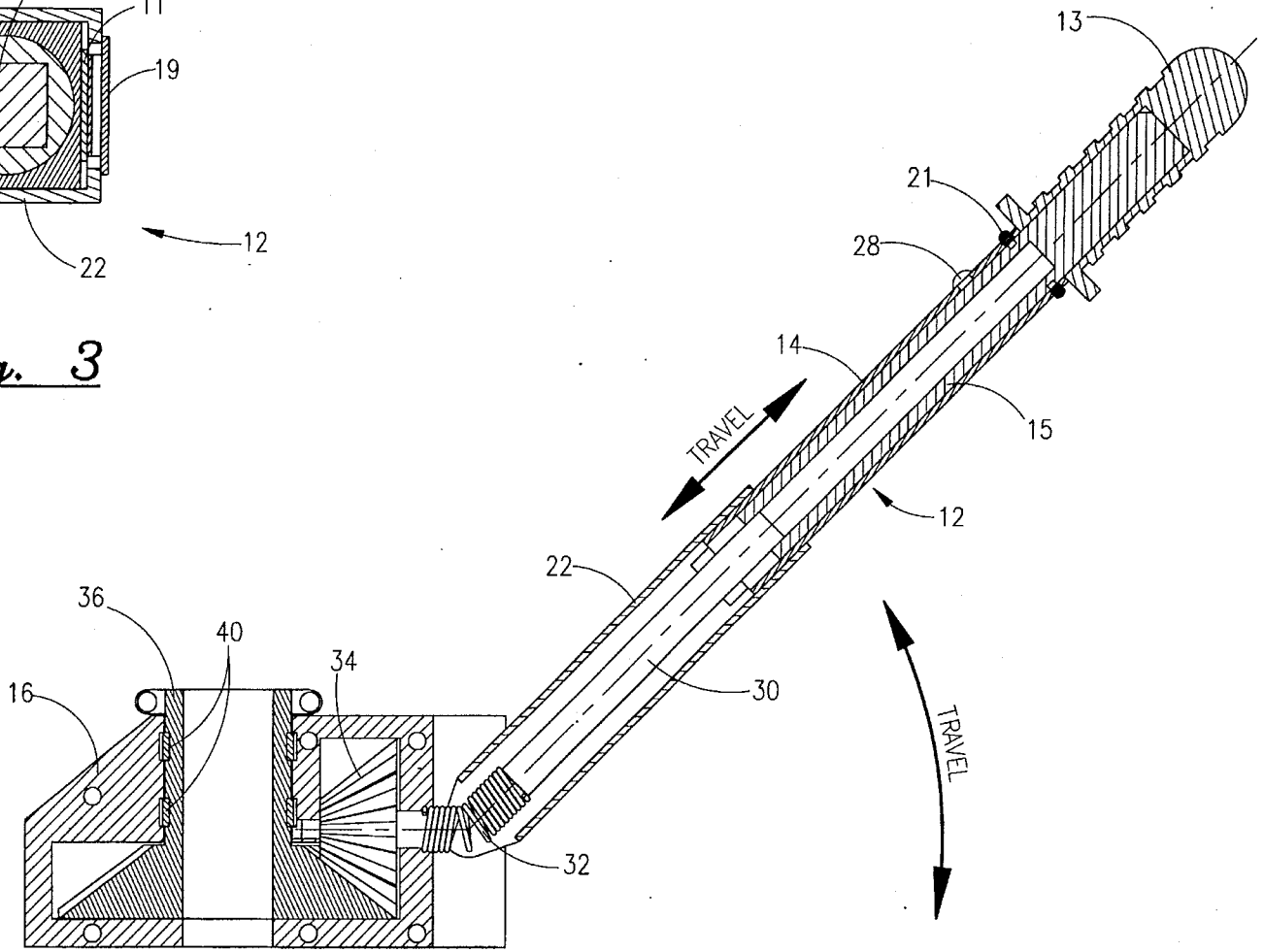
FIG. 4 is a cross sectional elevation view taken along 4—4 in FIG. 1.

The bevel gear **36*a*,36*b* seen in FIG. 4 positions the tolling motor 20 and its drive housing 18, thereby directing the motor 20 through 360 degrees of rotation. This allows the extendable handle or pivotal handle or lever 12 to remain stationary while rotating the handgrip 13 thus rotating the tolling motor 20 in a continuous 360 degrees forward or backwards if necessary. The intermediate member's 14 ability to slide in and out of the pivotal sleeve 22 which is vertically pivotal with respect to the split gear housing or case 16 allows the handgrip 13** to be grasped from an extended and elevated position.

Electrical power is provided from a battery 24 source via electric wiring 26 to the sliding contacts 19 attached to pivotal sleeve 22 where contact is made with contact strips 11 attached to each side of intermediate slide member 14 thus providing commutation. An electrical on-off switch 28 near the end of the intermediate slide member 14 adjacent the hand grip 13 is provided for making and breaking contact between the two contact strips 11. The intermediate slide member 14 is retained in rotatable alignment with the handle 15 by set screw 21 running in a grove 23. Electrical power is also provided via wiring 26 from the battery supply 24 to spring loaded brush contacts 44 located in the gear housing **16*a* thus providing commutation. These brush contacts 44 ride on slip rings 40 secured to each half of the bevel gear 36*a*, 36*b*. Electrical wiring 46 leading from the slip ring 40 located in the bevel gear 36*b* allows for continuous electrical contact to the existing tolling motor 20 regardless of which direction the motor 20 is turned. The positive side of the battery 24 is connected to one of the brush contacts 44 which makes contact with one of the slip rings 40 attached to the split bevel gear 36*a*,36*b*, thus making contact with one of the wires 46 leading to the motor 20. After leaving the motor 20 via the opposite wire 46 power is passed to the opposite slip ring 40 and out of the gear housing 16 a through the opposite brush contacts 44 and jumpered to one of the spring contacts 19 on the pivot sleeve 22, where contact is made with the strip 11 leading to the switch 28. When contact is made across the switch 28 a return path is completed to the opposite strip 11 which in turn leads back to the negative side of the battery 24**.

Figure 2:
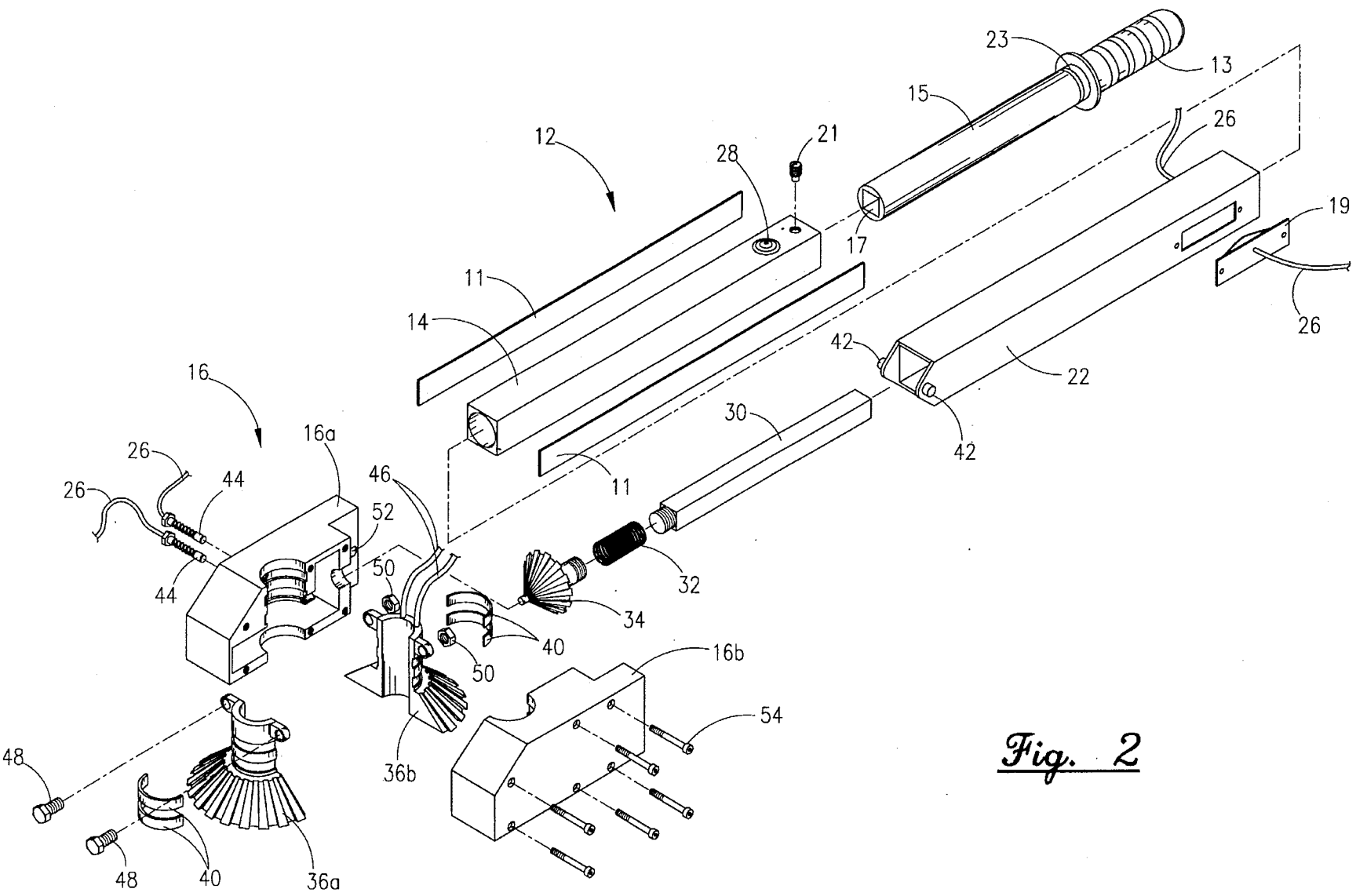
FIG. 2 is an isometric exploded view of the invention in detail.
Figure 3:
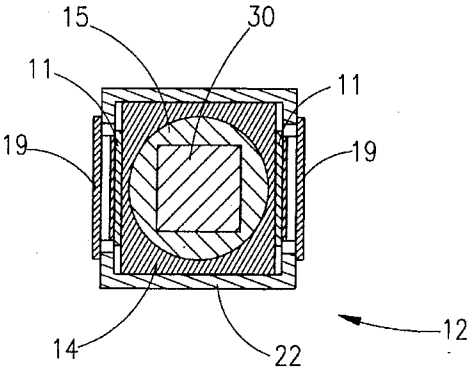
FIG. 3 is a cross section view taken along line 3—3 in FIG. 1.

Turning now to FIG. 2 we see that handle 15 comprises a rubber handgrip 13 and has a square internal spline 17. The handle 15 is telescopically fitted into intermediate slide member 14 which is constructed from a non-conductive square bar containing a round bore throughout its length. This arrangement can be seen in cross section in FIG. 3 & 4. The split gear housing **16*a*, 16*b* allows the bevel gear 36*a*,36*b* to be clamp mounted to an existing trolling motor axial shaft housing 18 with bolts 48 and nuts 50. Sleeves serving as shims may also be provided to compensate for different size shaft housings. Screws 54 pass through one half of the gear case or housing 16*b* and are threadably secured into the opposite half of the gear case or housing 16*a***.

What is claimed is:

1. An auxiliary steering handle, removably adaptable to the rotatable steering column of an electric trolling motor for start-stop operation and mechanical control steering of said motor through a continuous 360 degree rotation, said auxiliary steering handle comprising an attachment section adapted to be removably fixedly connected to said rotatable steering column and a telescopic extension handle section pivotally attached to said attachment section for effecting rotary movement of said steering axis in response to axial rotation of said auxiliary steering handle.

2. An auxiliary steering handle in accordance with claim 1 wherein said attachment section further comprises:

a) a bevel gear having a tubular hub and an axial bore therein split along said axial bore into two essentially equal halves, for clampable adaptation to said steering column;

b) a pinion gear in rotatable contact with said bevel gear; and c) a generally rectangular case, split longitudinal into essentially two equal halves, surrounding and supporting said bevel and pinion gears, said extension handle section being clamped pivotally between said two equal halves of said rectangular case.

3. An auxiliary steering handle in accordance with claim 2 wherein said extension handle section further comprises:

a) a primary rotary member having a hand grip portion;

b) a secondary rotary member telescopically operable within said primary rotary member;

c) an intermediate sliding member for receiving said primary rotary member;

d) a sleeve member for telescopically receiving said intermediate sliding member and said primary and secondary rotary members; and e) a flexible means for attaching said secondary rotary member to said pinion gear.

4. An auxiliary steering handle in accordance with claim 3 wherein said attachment section further comprises:

a) at least two electrical contact brush elements for making appropriate terminal connection between a battery and said sleeve member, respectively;

b) at least two slip rings secured to said bevel gear in sliding contact with said contact brush elements; and c) wiring connected to said slip rings for making appropriate contact with an electric trolling motor.

5. An auxiliary steering handle in accordance with claim 3 wherein said extension handle section further comprises:

a) at least two electrical contact strips attached to said intermediate slide member, one in sliding contact with appropriate wiring leading to terminal of said battery opposite said terminal connection leading to said brush element and one in sliding contact with appropriate wiring leading to one of said brush elements, respectively; and b) a switch means for making contact between said two electrical contact strips.

6. An auxiliary steering handle, removably adaptable to the rotatable steering column of an electric trolling motor for start-stop operation and mechanical control steering of said motor through a continuous 360 degree rotation, said auxiliary steering handle comprising:

a) an attachment section, adapted to be removably fixedly connected to said trolling motor's vertical steering axis;

b) a telescopic extension handle section pivotally attached to said attachment section for effecting rotary movement of said vertical steering axis in response to axial rotation of said auxiliary steering handle; and c) an electrical commutation means, located within said attachment and said telescopic section, for providing sliding electrical contact between a battery and an electric trolling motor.

7. An auxiliary steering handle in accordance with claim 6 wherein said attachment section further comprises:

a) a bevel gear having a tubular hub and an axial bore therein split along said axial bore into two essentially equal halves, for clampable adaptation to said rotatable steering column;

b) a pinion gear in rotatable contact with said bevel gear; and c) a generally rectangular case, split longitudinal into essentially two equal halves, surrounding and supporting said bevel and pinion gears, said extension handle section being clamped pivotally between said two equal halves of said rectangular case.

8. An auxiliary steering handle in accordance with claim 7 wherein said extension handle section further comprises:

a) a primary rotary member having a hand grip portion;

b) a secondary rotary member telescopically operable within said primary rotary member;

c) an intermediate sliding member for receiving said primary rotary member;

d) a sleeve member for telescopically receiving said intermediate sliding member and said primary and secondary rotary members; and e) a flexible means for attaching said secondary rotary member to said pinion gear.

9. An auxiliary steering handle in accordance with claim 8 wherein said attachment section further comprises:

a) at least two electrical contact brush elements for making appropriate contact with one terminal of a battery and said sleeve member, respectively;

b) at least two slip rings secured to said bevel gear in sliding contact with said contact brush elements; and c) wiring connected to said slip rings for making appropriate contact with an electric trolling motor.

10. An auxiliary handle in accordance with claim 9 wherein said extension handle section further comprises:

a) at least two electrical contact strips attached to said intermediate slide member, one in sliding contact with appropriate wiring leading to terminal of said battery opposite said terminal connection leading to said brush element and one in sliding contact with appropriate wiring leading to one of said brush elements, respectively; and b) a switch means for making contact between said two electrical contact strips.

* * * * *